US008163107B2

(12) United States Patent
Soshiroda et al.

(10) Patent No.: US 8,163,107 B2
(45) Date of Patent: Apr. 24, 2012

(54) HIGH-STRENGTH STEEL EXCELLENT IN WELDABILITY AND PROCESS FOR PRODUCTION THEREOF

(75) Inventors: Tetsuo Soshiroda, Kakogawa (JP); Tetsuji Hoshika, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 727 days.

(21) Appl. No.: 12/279,552

(22) PCT Filed: Mar. 12, 2007

(86) PCT No.: PCT/JP2007/054786

§ 371 (c)(1),
(2), (4) Date: Aug. 15, 2008

(87) PCT Pub. No.: WO2007/108344

PCT Pub. Date: Sep. 27, 2007

(65) Prior Publication Data

US 2009/0065098 A1 Mar. 12, 2009

(30) Foreign Application Priority Data

Mar. 17, 2006 (JP) ..... 2006-075303
Jan. 16, 2007 (JP) ..... 2007-007402

(51) Int. Cl.
*C22C 38/00* (2006.01)

(52) U.S. Cl. ..... 148/328; 148/320

(58) Field of Classification Search ..... 148/206–236, 148/238, 500, 505, 316–320, 328, 405, 901; 420/128, 129, 590, 591; *C21D 3/08; C23C 8/24, C23C 8/26; C22C 29/16, 38/14, 38/00*
See application file for complete search history.

(56) References Cited

U.S. PATENT DOCUMENTS 3,847,682 A 11/1974 Hook
(Continued)

FOREIGN PATENT DOCUMENTS

JP 7 54126 2/1995
(Continued)

OTHER PUBLICATIONS

Office Action issued on Jan. 19, 2011 in the corresponding United Kingdom Patent Application No. GB0819048.0.

(Continued)

*Primary Examiner* — Scott Kastler
*Assistant Examiner* — Vanessa Luk
(74) *Attorney, Agent, or Firm* — Oblon, Spivak, McClelland, Maier & Neustadt, L.L.P.

(57) ABSTRACT

The present invention provides a high-strength steel material capable of suppressing formation of blowholes during welding even if the strength thereof is improved by nitriding, and a method of manufacturing such a high-strength steel material by using a low rolling force. A high-strength steel of the present invention contains 0.05% (percent by mass unless otherwise specified in describing chemical composition) or below C, 1% or below Si, 1.5% or below Mn, 0.05% or below P, 0.05% or below S, 0.05% or below Al, 0.02 to 0.3% Ti, and 0.020% or below N. The high-strength steel material has metallographic structure of a single phase of ferrite and contains Ti nitride grains having a maximum size of 20 nm or below and coherently precipitated in a density of 250 grains/$\mu m^2$ or above. In the high-strength steel material, the ratio of the number of Ti nitride grains having a maximum size of 6 nm or below to that of Ti nitride grains having a maximum size of 20 nm or below is 80% or above.

4 Claims, 2 Drawing Sheets

U.S. PATENT DOCUMENTS

| | | | | |
|---|---|---|---|---|
| 4,105,474 | A * | 8/1978 | Nakasugi et al. | 148/506 |
| 6,280,538 | B1 | 8/2001 | Soshiroda et al. | |
| 6,645,320 | B2 | 11/2003 | Asai et al. | |
| 6,686,061 | B2 * | 2/2004 | Jeong et al. | 428/684 |
| 2005/0155673 | A1 | 7/2005 | Soshiroda et al. | |
| 2007/0144620 | A1 | 6/2007 | Soshiroda et al. | |

FOREIGN PATENT DOCUMENTS

| | | | |
|---|---|---|---|
| JP | 2000 34540 | | 2/2000 |
| JP | 2001 507080 | | 5/2001 |
| JP | 2003 342675 | | 12/2003 |
| JP | 2005-126738 | * | 5/2005 |
| JP | 2005 126738 | | 5/2005 |
| JP | 2007 9325 | | 1/2007 |

OTHER PUBLICATIONS

U.S. Appl. No. 12/671,453, filed Jan. 29, 2010, Nakaya, et al.

U.S. Appl. No. 11/908,423, filed Sep. 12, 2007, Satou, et al.

* cited by examiner

HIGH-STRENGTH STEEL EXCELLENT IN WELDABILITY AND PROCESS FOR PRODUCTION THEREOF

This application is a 371 of PCT/JP2007/054786, tiled Mar. 12, 2007.

TECHNICAL FIELD

The present invention relates to a steel material excellent in workability, weldability and strength and, more particularly, to a steel material suitable for use as a material for forming automotive bodies.

BACKGROUND ART

The automobile industry is required to reduce fuel consumption through weight reduction and demand for high-strength steel plates has been increased to achieve weight reduction.

The strength of steel plates has been improved by precipitation strengthening that precipitates carbides in a steel, a solution strengthening that adds Si and Mn to a steel or strengthening that produces low-temperature transformation products.

When carbon content is increased for precipitation strengthening by carbides, weldability deteriorates in some cases. When a large amount of alloy elements, such as Si and Mn, is added, chemical conversion treatability deteriorates or manufacturing cost increases in some cases. When a large amount of alloy elements is added, the strength of steel plates increases excessively during hot rolling and cold rolling requiring higher rolling force and it is difficult to manufacture steel plates of a desired size (thickness and width).

Technique proposed in Patent document 1 reduces the amount of alloy elements contained in a steel plate to reduce the strength so that the steel plate can be hot rolled or cold rolled without increasing rolling force and enhances the strength by precipitating Ti nitride produced by nitriding Ti contained in the steel by annealing after rolling. However, the control of an atmosphere for a nitriding process is difficult. If N is dissolved excessively in a steel, blowholes are formed in the steel during welding, the strength of a welded joint is reduced and weldability is deteriorated. Patent document 1 cools a coil of a nitrided steel directly to an ordinary temperature and hence an excessively large amount of N is dissolved in the steel. Nitrogen contained in the steel produces blowholes during welding and hence the weldability of the steel is unsatisfactory.

Patent Document 1: JP-A 2001-507080

DISCLOSURE OF THE INVENTION

Problem to be Solved by the Invention

The present invention has been made in view of the foregoing circumstances and it is therefore an object of the present invention to provide a high-strength steel material capable of suppressing formation of blowholes during welding even if the strength thereof is improved by nitriding. Another object of the present invention is to provide a method of manufacturing such a high-strength steel material by using a low rolling force.

Means for Solving the Problem

The inventors of the present invention made studies to provide a method of manufacturing a steel material having strength increased without deteriorating weldability by using a low rolling force and found through the studies that Ti nitride can be precipitated in a steel and can achieve strengthening by nitriding a cold-rolled or hot-rolled steel material, and subjecting the steel material to a denitrating process and a Ti nitride precipitating process in that order, that rolling force can be reduced because Ti nitride does not precipitate during rolling, and that the steel material can be strengthened without deteriorating weldability because fine Ti nitride grains of a maximum size of 20 nm or below are coherently precipitated in the steel material containing 0.020% or below N. The present invention is based on such findings.

A high-strength steel of the present invention capable of solving the foregoing problems contains 0.05% (percent by mass unless otherwise specified in describing chemical composition) or below C, 1% or below Si, 1.5% or below Mn, 0.05% or below P, 0.05% or below S, 0.05% or below Al, 0.02 to 0.3% Ti, and 0.020% or below N, has metallographic structure of a single phase of ferrite, and contains Ti nitride grains having a maximum size of 20 nm or below and coherently precipitated in a density of 250 grains/$\mu m^2$ or above.

In this high-strength steel, the ratio of the number of Ti nitride grains having a maximum size of 6 nm or below to that of Ti nitride grains having a maximum size of 20 nm or below is 80% or above.

The steel material has an effective Ti* content calculated by using Expression (1) in the range of 0.02 to 0.08%.

$$Ti^*=[Ti]-48\times([C]/12+[S]/32) \quad (1)$$

where a numeral in [ ] indicates an element content (%) of the steel material.

The high-strength steel material of the present invention can be manufactured by processing an untreated steel material after hot rolling or cold rolling by a nitriding process, a denitrating process and a Ti nitride precipitating process in that order in an annealing furnace. More concretely, a nitriding step (a) of nitriding the untreated steel material containing 0.02 to 0.3% Ti and 0.005% or below N (excluding 0%) at a temperature in the range of 500° C. to 610° C. in a nitriding atmosphere containing a nitriding gas; a denitrating step (b) of denitrating the nitrided steel material by leaving the nitrided steel material at a temperature in the range of 500° C. to 610° C. in a denitrating atmosphere not containing any nitriding gas; and a precipitating step (c) of precipitating Ti nitride by heating the denitrated steel material at a temperature in the range of 640° C. to 750° C. may be executed in that order after hot rolling or cold rolling.

Preferably, a gas forming the nitriding atmosphere for the nitriding step is a mixed gas containing hydrogen, nitrogen and ammonia. Preferably, a gas forming the denitrating atmosphere for the denitrating step is a nonoxidative gas. Preferably, a gas forming an atmosphere for the Ti nitride precipitating step is a nonoxidative gas.

The untreated steel material may be processed by a forming process prior to the nitriding process or the nitriding step.

The morphology of the steel material is not limited to any specific shape. The steel material may be a steel plate or a formed steel article. The present invention designates a steel plate obtained by subjecting a untreated steel plate to a nitriding process, a denitrating process and a Ti nitride precipitating process in that order as a "high-strength steel plate" and designates an article obtained by subjecting a formed article to a nitriding process, a denitrating process and a Ti nitride precipitating process in that order as a "high-strength steel member".

EFFECT OF THE INVENTION

The present invention executes the nitriding process after rolling, the strength enhancing effect of Ti nitride can be utilized without increasing rolling force. Since the denitrating process is executed after the nitriding process, surplus N dissolved in the steel can be removed. Fine Ti nitride grains can be precipitated by executing the Ti nitride precipitating process after the denitrating process. The steel material thus manufactured and containing 0.020% or below N is excellent in weldability. Since fine Ti nitride grains of a maximum size of 20 nm or below are precipitated, the steel material has an improved strength.

BEST MODE FOR CARRYING OUT THE INVENTION

Figure 1:
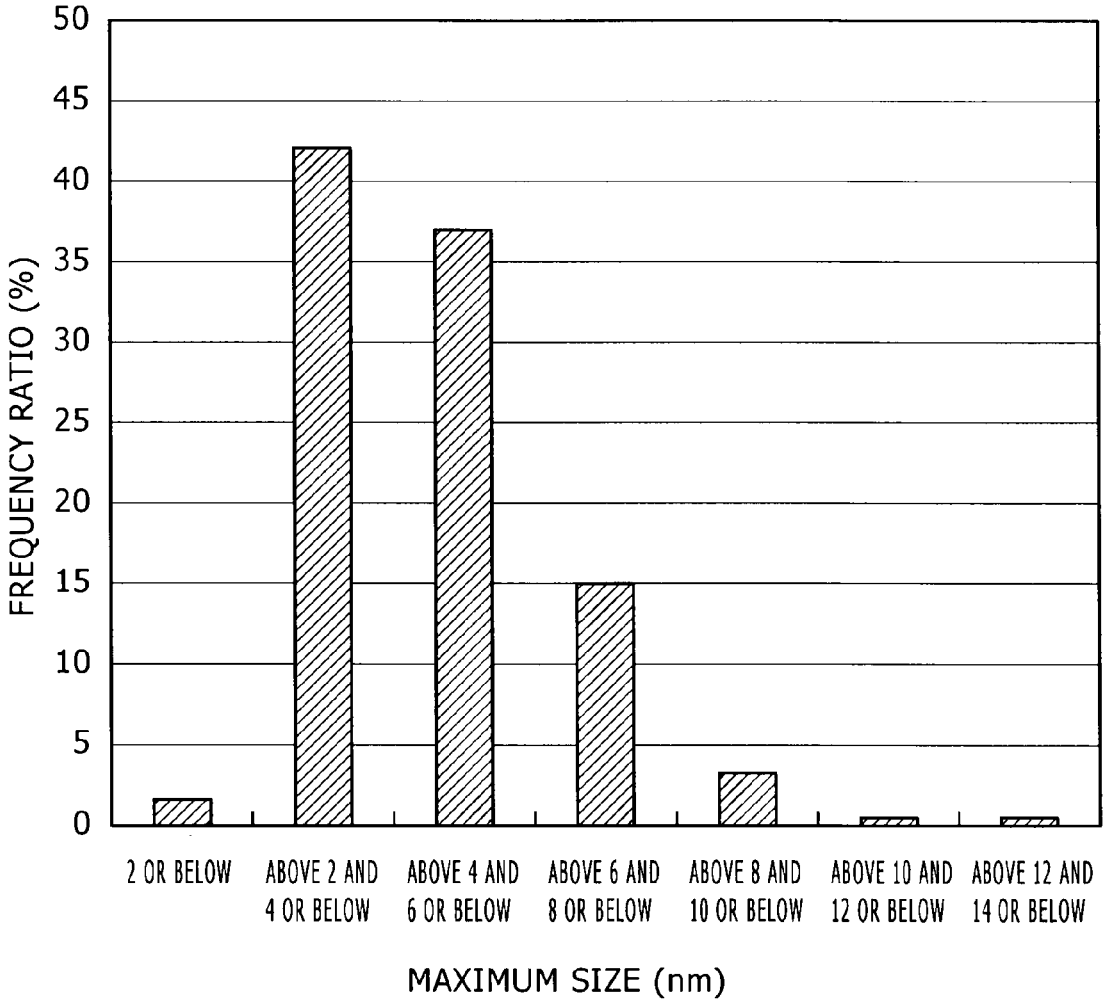
FIG. 1 is a graph showing the distribution of Ti nitride.

A method of manufacturing a high-strength steel material of the present invention will be described. The high-strength steel material of the present invention is manufactured by subjecting a steel material obtained by processing an ingot steel by a usual hot rolling process (or a usual cold rolling process when necessary) sequentially to a nitriding process, a denitrating process and a Ti nitride precipitating process in that order.

The steel of the ingot steel contains 0.02 to 0.3% Ti and 0.005% or below N (including 0%). The present invention strengthens the steel material containing Ti and obtained by usual hot rolling process (or a usual cold rolling process when necessary) by producing Ti nitride in the steel material by a procedure, which will be described later, including a nitriding process. The present invention produces Ti nitride in such a manner because Ti nitride precipitates in the ingot steel before the ingot steel is subjected to rolling if the ingot steel contains Ti and surplus N, the Ti nitride strengthens the ingot steel and, consequently, rolling force cannot be reduced. The N content of the ingot steel can be limited to 0.005% or below by removing N from the molten steel at a melting stage by degassing or the like.

It is preferable for strengthening the steel by precipitating Ti nitride by a process following a rolling process that the Ti content of the ingot steel is 0.02% or above, desirably, 0.025% or above, more desirably, 0.03% or above. Coarse Ti nitride grains are liable to be formed, the strength of the steel is reduced and a high-strength steel as an end product excessively containing N has inferior weldability. Therefore, the Ti content is 0.3% or below, preferably, 0.2% or below, more desirably, 0.1% or below.

The rolled steel material is subjected to a nitriding process (a) (hereinafter, referred to also as "nitriding step" in some cases) for nitriding the steel material at a temperature in the range of 500° C. to 610° C. in a nitriding atmosphere containing a nitriding gas; a denitrating process (b) (hereinafter, referred also to "denitrating step" in some cases) for denitrating the nitrided steel material by leaving the nitrided steel material at a temperature in the range of 500° C. to 610° C. in a denitrating atmosphere not containing any nitriding gas; and a Ti nitride precipitating process (c) (hereinafter, referred to also as "Ti nitride precipitating step" in some cases) of heating the denitrated steel material at a temperature in the range of 640° C. to 750° C.

The nitriding step heats the steel material containing Ti at a comparatively low temperature in an atmosphere containing a nitriding gas to form nitrogen clusters in the steel. The denitrating step removes surplus N introduced into the steel material in the preceding nitriding step and dissolved in the steel to reduce the N content of the steel. The denitrating process succeeding the nitriding process removes surplus N introduced into and dissolved in the steel by nitriding process. However, N contained in clusters of Ti and N is not denitrated. Therefore, when the steel material is heated, as will be mentioned layer, after the denitrating step, Ti nitride precipitates from the clusters of Ti and N in the steel and the Ti nitride precipitated in the steel strengthens the steel material.

If the steel material is cooled to a room temperature without denitrating the steel material after nitriding, the surplus dissolved N introduced into the steel forms Fe nitrides, such as $Fe_4N$ and $Fe_{16}N_2$. Even though the Fe nitrides contribute scarcely to strengthening the steel material, the Fe nitrides increase the N content of the steel and cause the deterioration of weldability. Once the Fe nitrides are formed, the steel cannot be denitrated by reheating.

The Ti nitride precipitating step following the denitrating step heats the steel material at a comparatively high temperature to precipitate Ti nitride from the clusters of Ti and N in the steel to strengthen the steel material. Although the Ti nitride precipitating step heats the steel material at a comparatively high temperature the steel is austenitized as the surplus N introduced into the steel is removed, the coherent precipitation of Ti nitride is not obstructed, and coarse Ti nitride grains are not formed.

The nitriding step (a), the denitrating step (b) and the Ti nitride precipitating step (c) will be described below.

The nitriding step (a) heats a rolled steel material containing Ti for nitriding at a comparatively low temperature in the range of 500° C. to 610° C. in a nitriding atmosphere containing a nitriding gas. Thus clusters of Ti and N can be formed in the steel. If the heating temperature is below 500° C., clusters of Ti and N are not formed and N introduced into the steel by nitriding is dissolved in the steel. Consequently, the dissolved N is removed by the denitrating process following the nitriding process and the Ti nitride precipitating process cannot precipitate Ti nitride. Therefore, the nitriding process heats the steel material at a heating temperature of 500° C. or above, preferably, 510° C. or above, more desirably, 520° C. or above. If the heating temperature is above 610° C., the base steel is austenitized, Ti nitride cannot be precipitated coherently and the steel material cannot be strengthened. Further in the heating temperature of above 610° C., coarse Ti nitride gains are formed, nitrides of other elements are produced, the N content increases eventually and weldability is deteriorated. Thus the heating temperature of the nitriding process is 610° C. or below, preferably, 600° C. or below.

The nitriding step is executed in an atmosphere containing a nitriding gas. The nitriding gas may contain, for example, ammonia and nonoxidative gases as other components. Possible nonoxidative gases are, for example, gases of hydrogen, helium, argon and nitrogen. Those nonoxidative gases may be individually used or in a mixed gas. Nitrogen gas cannot exhibit a nitriding effect at temperatures in the range of 500° C. to 610° C. and hence cannot be used as a nitriding gas.

It is particularly preferable to execute the nitriding step in an atmosphere of a mixed gas containing hydrogen, nitrogen and ammonia. Use of a mixed gas containing hydrogen, nitrogen and ammonia can raise nitriding rate still further. Preferably, the concentration of ammonia in the mixed gas is 1% vol. (percent by volume) or above, more desirably, 3% vol. or above. If the concentration of ammonia gas is excessively high, nitriding potential is excessively high and a thick Fe nitride layer is formed in the surface of the steel material, which increases time necessary for denitration and is economically undesirable. Therefore, it is preferable that the concentration of ammonia gas is 10% vol. or below, more desirably, 8% vol. or below.

Preferably, the denitrating step (b) is executed in an atmosphere not containing any nitriding gas at a temperature in the range of 500° C. to 610° C. Surplus N introduced into and dissolved in the steel by the preceding nitriding step can be removed by denitration at a comparatively low denitrating temperature in the range of 500° C. to 610° C. If the denitrating temperature is below 500° C., satisfactory denitration cannot be achieved, and much N remains dissolved in the steel. Eventually, the steel has a high N content and the weldability of the steel is deteriorated. When a steel containing much N dissolved therein is subjected to the Ti nitride precipitating process, the base steel is austenitized, Ti nitride cannot be coherently precipitated in the ferritic steel and hence the steel material cannot be strengthened. Therefore the heating temperature of the denitrating process is 500° C. or above, preferably, 510° C. or above, more desirably, 520° C. or above. If the heating temperature of the denitrating process is above 610° C., the base steel is austenitized. Consequently, Ti nitride cannot be coherently precipitated in the ferrite. Moreover, Ti nitride grains grow large before the denitration is ended, nitrides of other elements are produced and, eventually, the N content of the steel increases and the weldability of the steel material deteriorates. Therefore, the heating temperature of the denitrating process is 610° C. or blow, preferably, 600° C. or below.

The denitrating step is executed in an atmosphere not containing a nitriding gas to remove N dissolved in the nitrided base steel from the base steel.

The atmosphere for the denitrating step may contain the nonoxidative gas mentioned in connection with the description of the nitriding process (a) to avoid oxidizing the surface of the steel material. If nitrogen gas is used as the nonoxidative gas, it is preferable that the concentration of nitrogen gas is 10% vol. or below to achieve denitration efficiently.

The Ti nitride precipitating step (c) heats the denitrated steel material at a temperature in the range of 640° C. to 750° C. to precipitate Ti nitride. The Ti nitride precipitating step can precipitate Ti nitride in the steel from the clusters of Ti and N formed in the steel in the nitriding step by heating the steel material at a relatively high heating temperature as compared with the nitriding and the denitrating step. The steel material can be strengthened by precipitating Ti nitride. Since the surplus N introduced into the steel is removed by the preceding denitrating step, the base steel is not austenitized even if the steel material is heated at a temperature of 640° C. or above and Ti nitride can be precipitated in a ferrite structure. Therefore, a steel having Ti nitride precipitated coherently in a ferrite structure can be obtained when the steel material is cooled to a room temperature after the Ti nitride precipitating step. If the heating temperature is below 640° C., N contained in the clusters cannot be satisfactorily diffused. Consequently, Ti nitride cannot be precipitated and the steel material cannot be satisfactorily strengthened. Although Ti nitride can be precipitated by continuing the Ti nitride precipitating step for a long time even if the steel material is heated at a low temperature for Ti nitride precipitation, the use of such a low heating temperature is not preferable because production efficiency reduces. Therefore, the heating temperature for the Ti nitride precipitating process is 640° C. or above, preferably 650° C. or above. If the heating temperature of the Ti nitride precipitating process is above 750° C., the base steel is austenitized, Ti nitride cannot be precipitated coherently in the ferrite structure and the steel material cannot be strengthened. Thus the heating temperature for the Ti nitride precipitating process is 750° C. or below, preferably, 730° C. or below, more desirably, 700° C. or below.

There are not any limitative conditions for the gas of the atmosphere for the Ti nitride precipitating step. It is preferable to use the nonoxidative gas mentioned in connection with the description of the process (a) to avoid oxidizing the surface of the steel material. The nonoxidative gas may contain nitrogen. However, it is preferable that the concentration of N in the mixed gas is 10% vol. or below to prevent the precipitation of Fe nitrides in the steel during cooling due to increase in the amount of N dissolved in the steel.

There are not particular restrictions on the shape of the unprocessed steel material. For example, the steel material may be a steel plate or a formed article.

When the unprocessed steel material is a steel plate, an unprocessed steel plate obtained by hot-rolling (or cold-rolling when necessary) an ingot steel may be processed by the nitriding process, the denitrating process and the Ti nitride precipitating process.

When the unprocessed steel material is a steel plate, there are not particular restrictions on the thickness of the steel plate. Thin steel sheets are often used for forming automotive bodies. Generally, the thickness of the thin steel sheets is below 3 mm, preferably, 2 mm or below, more desirably, in the range of about 0.6 to about 1.5 mm.

When the unprocessed steel material is a formed article, the unprocessed steel material may be processed by a forming process, such as a press working process before subjecting the same to the nitriding process (nitriding step). An ingot steel is processed by usual hot-rolling (cold-rolling when necessary), the rolled steel material is processed by a forming process to obtain a formed article, and then the formed article material may be processed by the nitriding process, the denitrating process and the Ti nitride precipitating process.

There is not particular restriction on the type of the forming process; the forming process may be any one of a press working process, a spinning process, a roll forming process and such. There are not particular limitative conditions for the forming process; the forming process may be carried out under usual conditions.

The surface of a high-strength steel material manufactured by the foregoing manufacturing method of the present invention may be plated by any one of a hot dip zinc plating process, an alloying hot dip zinc plating process, an electrogalvanizing process and various coating processes.

The high-strength steel material of the present invention thus manufactured has metallographic structure of a single phase of ferrite, contains 0.020% or below N (excluding 0%) and contains coherently precipitated Ti nitride grains of a maximum size of 20 nm or below in a density of 250 grains/$\mu m^2$ or above. The high-strength steel material of the present invention will be minutely described.

The high-strength steel material of the present invention has metallographic structure of a single phase of ferrite and contains 0.020% or below N. Since the steel material has a N content 0.020% or below, this steel material does not form blowholes when the steel material is welded and has improved weldability. Since the high-strength steel material has a N content of 0.02% or below and contains fine Ti nitride grains of a maximum size of 20 nm or below in a density of 250 grains/$\mu m^2$, the high-strength steel material is strengthened. Preferably, the N content is 0.019% or below, more desirably, 0.018% or below.

Preferably, the density of the coherently precipitated Ti nitride grains is 255 grains/$\mu m^2$ or above, more desirably, 260 grains/$\mu m^2$ or above. It is preferable to produce Ti nitride as much as possible such that the N content of the high-strength steel material is below 0.02%.

Coherent precipitation is a condition such that atoms on the opposite sides of the interface between Ti nitride and Fe, namely, a base material, are in one-to-one correspondence and precipitated gains are continuous. Whether or not Ti nitride is coherently precipitated can be determined for example, by determining whether or not there is contrast between precipitate and the base phase due to coherency strain through observation of the structure under a field emission transmission electron microscope (Fe-TEM).

Maximum sizes of the Ti nitride grains may be determined by measuring, with a vernier caliper, the sizes of pictures of grains magnified at a 250,000× magnification obtained by enlarging a micrograph of a section of the high-strength steel material taken at a 100,000× magnification by using a transmission electron microscope.

In the high-strength steel of the present invention, the ratio of the number of Ti nitride gains of a maximum size of 6 nm or below to that of Ti nitride grains of a maximum size of 20 nm or below is 80% or above. Thus the high-strength steel material contains a large number of Ti nitride grains of a maximum size of 6 nm or below.

A photograph for calculating the ratio of the number of Ti nitride gains is a photograph of a section of the high-strength steel material at a 330,000× magnification obtained by enlarging a micrograph of the section of the high-strength steel material taken at a 150,000× magnification by using a transmission electron microscope. Maximum sizes of the Ti nitride grains are measured with a vernier caliper, and the ratio may be calculated by using a frequency distribution table of the measured maximum gain sizes. A measuring area is 500 nm×500 nm, the maximum sizes of 120 Ti nitride grains in each of two visual fields may be measured.

Preferably, coarse precipitated grains of maximum sizes of 100 nm or above are not found when a section of the high-strength steel material of the present invention magnified at a 10,000× magnification is observed through a transmission electron microscope because increase in the coarse precipitated grains deteriorates stretch-flanging property.

Precipitated grains other than Ti nitride gains are those of carbides, sulfides, Al nitride, and oxide inclusions, such as $Al_2O_3$ and $SiO_2$.

The high-strength steel of the present invention contains C, S and Ti. Preferably, the steel material has an effective Ti* content calculated by using Expression (1) in the range of 0.02 to 0.08%.

$$Ti^*=[Ti]-48\times([C]/12+[S]/32) \quad (1)$$

where characters in [ ] indicate element contents (%) of the steel material.

The effective Ti* content represents the amount of Ti that can be combined with N, contained in the high-strength steel material. An effective Ti* content below 0.02% indicates that the amount of Ti nitride is small and the steel material cannot be strengthened. Therefore, it is preferable that the effective Ti* content is 0.02% or above, more desirably, 0.025% or above. When the effective Ti* content is above 0.08%, N is introduced excessively into the base steel during nitriding and, eventually, the N content of the steel material increases excessively to deteriorate the weldability of the steel material. Therefore, it is preferable that the effective Ti* content is 0.008% or below, more desirably, 0.075% or below.

The composition of the high-strength steel material of the present invention can be adjusted so as to meet the condition expressed by Expression (1) by adjusting the composition of the base steel during the manufacture of the base steel so that the C, the S and the Ti content of the base steel may meet the condition expressed by Expression (1).

Although there is not any limitative condition of the concrete composition of the high-strength steel material, the following C and S contents are preferable.

C Content: 0.05% or Below (Excluding 0%)

Carbon (C) is an important element for strengthening steel materials. It is preferable that the C content is 0.05% or below to manufacture the steel material of metallographic structure of a single phase of ferrite. Carbon (C) combines with Ti to form Ti carbide, which reduces the effective Ti* content. Therefore it is preferable that the steel material has the lowest possible C content. Preferably, the C content is 0.03% or below, more desirably, 0.01% or below.

S Content: 0.05% or Below (Excluding 0%)

Sulfur (S) combines with Ti to form Ti sulfide (titanium disulfide: $TiS_2$), which reduces the effective Ti* content. Therefore it is preferable that the steel material has the lowest possible Si content. Preferably, the Si content is 0.05% or below, desirably, 0.03% or below, more desirably, 0.01% or below. The steel material contains S unavoidably in a S content on the order of 0.005%.

It is desirable that the high-strength steel material of the present invention contains alloying elements as scarcely as possible to reduce rolling force. However, the high-strength steel material usually contains Si, Mn, P and Al. Preferable ranges of Si, Mn, P and Al contents are shown below.

Si Content: 1% or Below (Excluding 0%)

Excessive Si deteriorates the property of being plated. Therefore, it is preferable that the Si content is 1% or below, desirably, 0.5% or below, more desirably, 0.3% or below. Silicon (Si) is effective in strengthening the steel material through solid solution hardening. Thus the steel material may have a Si content of 0.01% or above, preferably, 0.05% or above.

Mn Content: 1.5% or below (Excluding 0%)

Excessive Mn deteriorates the property of being plated. Therefore, it is preferable that the Mn content is 1.5° or below, desirably, 1% or below, more desirably, 0.5% or below. Molybdenum (Mn), similarly to Si, is effective in strengthening the steel material through solid solution hardening. Thus the steel material may have a Mn content of 0.01% or above, preferably, 0.1% or above.

P Content: 0.05% or Below (Excluding 0%)

Weld crack is liable to occur when a steel material contains P excessively. Therefore, it is preferable that the P content is 0.05% or below, desirably, 0.03% or below, more desirably, 0.01% or below. The steel material contains P unavoidably in a P content on the order of 0.001%.

Al Content: 0.05% or below (Excluding 0%)

Aluminum (Al) combines with N to form Al nitride, and consumes N contained in a steel, which affects Ti nitride formation adversely. When Al nitride is formed, the amount of N contained in the steel material increases and weldability is deteriorated. Preferably, the Al content is 0.05% or below, desirably, 0.04% or below, more desirably, 0.03% or below. If Al is added to the steel material as a deoxidizing element, the steel material may contain Al in an Al content of 0.01% or above, preferably, 0.02% or above.

Other elements contained in the high-strength steel material of the present invention may be unavoidable impurities, such as tramp elements.

Steel plates of the present invention have high strength and are excellent in weldability. Therefore, the steel plates can be used as materials of, for example, parts and members of automotive suspensions, automotive sills, automotive pillars, and reinforcing parts, such as door impact beams and such.

The present invention includes high-strength members, such as parts and members of automotive suspensions, automotive sills, automotive pillars, and reinforcing parts, such as door impact beams and such, manufactured by subjecting articles obtained by forming the untreated steel plates to a nitriding process, a denitrating process and a Ti nitride precipitating process in that order. The high-strength members of the present invention can be applied to architectural and civil engineering uses.

Examples of the present invention will be minutely described. The following examples are not limitative, and proper changes may be made therein according to the foregoing and the following gist without departing from the scope of the present invention.

EXAMPLE 1

Steels respectively having compositions shown in Table 1 (other elements are Fe and unavoidable impurities) were melted by a vacuum melting process to produce ingot steels. The ingot steels were heated at 1250° C., the ingot steels heated at 950° C. for finish heating were hot-rolled at a winding temperature of 600° C. to obtain 2 mm thick hot-rolled steel sheets. Values of effective Ti* content calculated by using the values of the C, the S and the Ti contents of the hot-rolled steel sheets and Expression (1) are shown also in Table 1.

Both the opposite surfaces of the hot-rolled steel sheets thus obtained were ground to obtain 1 mm thick untreated steel sheets. Specimens sampled from the untreated steel sheets were degreased. The degreased steel sheets were subjected to a nitriding process, a denitrating process and a Ti nitride precipitating process in that order in an annealing furnace.

The nitriding process heated the specimens at temperatures shown in Table 2 for 2 h. The nitriding process was executed in an atmosphere of a mixed gas containing 1.25% vol. hydrogen gas, 23.75% vol. nitrogen gas, and 5% vol. ammonia gas. The denitrating process heated the specimens at temperatures shown in Table 2 for 4 h. The denitrating process was executed in an atmosphere of hydrogen gas. The Ti nitride precipitating process heated the specimens at temperatures shown in Table 2 for 4 h. The Ti nitride precipitating process was executed in an atmosphere of hydrogen gas.

Specimens Nos. 8 to 10 shown in Table 2 were processed by only the nitriding process and were not processed by the denitrating process and the Ti nitride precipitating process.

The respective N contents of the thus processed specimens were measured by an inert gas fusion thermal conductivity method. Measured data is shown in Table 2. The respective types of structure of the thus processed specimens were observed by the following procedure. Tensile strength and weldability of the specimens were evaluated by the following procedure.

A thicknesswise section of each specimen corroded with a nital etchant was examined for metallographic structure through observation under an optical microscope at a 400× magnification. It was confirmed that the specimens had metallographic structure of a single phase of ferrite.

Figure 2:
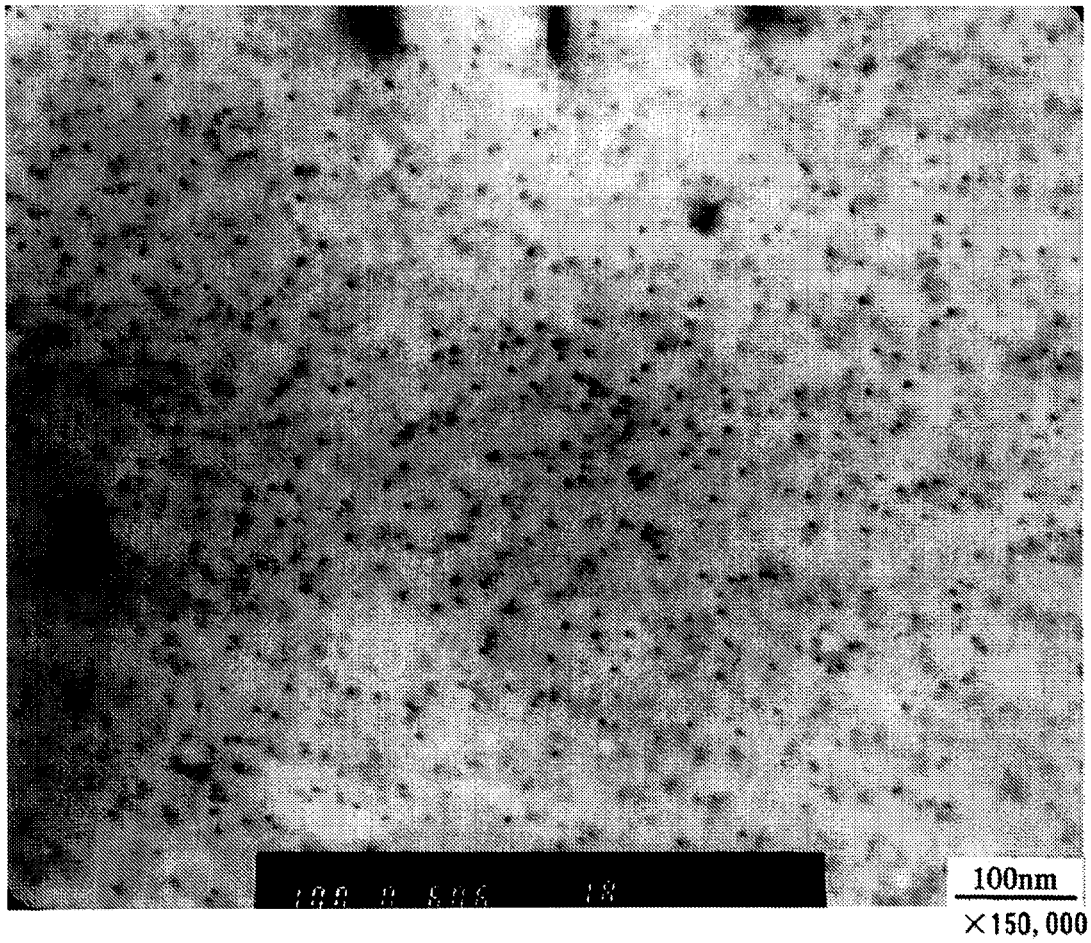
FIG. 2 is a photograph of a section of a specimen 1 shown in Table 2 taken at a 150,000× magnification by an electron microscope.

Parts of the section of each specimen in ten visual fields were observed under a transmission electron microscope at a 10,000× magnification and the sizes of precipitated grains were measured to find the number of coarse precipitated grains having a maximum size of 100 nm or above. The specimens were rated "no coarse precipitated grain", "not many coarse precipitated grains" or "many coarse precipitated grains" when the number of coarse precipitated grains having a maximum size of 100 nm or above in 1 $\mu m^2$ was zero, in the range of 1 to 10, or 11 or above, respectively. Results of evaluation are shown in Table 2. FIG. 2 is a photograph of a section of a specimen No. 1 shown in Table 2 taken by a transmission electron microscope at a 150,000× magnification.

The composition of the precipitated grain was analyzed by an extraction replica method using an energy dispersive x-ray spectrometer (EDX) attached to a transmission electron microscope (TEM).

Whether or not Ti nitride is coherently precipitated was determined by determining whether or not there is contrast between precipitate and the base phase (coherency strain contour) due to coherency strain through observation of the structure under a Fe-TEM. It was determined that coherent precipitation did not occur when there is not any coherency contour or that coherent precipitation occurred when there is a coherency contour.

Maximum sizes of coherently precipitated Ti nitride grains were determined by measuring, with a vernier caliper, the sizes of pictures of grains magnified at a 250,000× magnification obtained by enlarging a micrograph of the section of the specimen taken at a 100,000× magnification by using a transmission electron microscope. The numbers of Ti nitride grains having a maximum size of 20 nm or below in 1 $\mu m^2$ are shown in Table 2.

Ratio of the number of Ti nitride grains having a maximum size of 6 nm or below is shown in Table 2. A photograph of a section of the specimen at a 330,000× magnification obtained by enlarging a micrograph of the section of the specimen taken at a 150,000× magnification by using a transmission electron microscope was used to calculate the ratio of the number of Ti nitride gains having a maximum size of 6 nm or below. Maximum size of each of the Ti nitride grains was measured with a vernier caliper, and the ratio was calculated by using a frequency distribution table of the measured maximum gain sizes. A measuring area was 500 nm×500 nm, the maximum sizes of 120 Ti nitride grains in each of two visual fields were measured. FIG. 1 shows measured maximum sizes of Ti nitride grains.

Specimens specified in 5, JIS were sampled from the untreated steel sheets and the processed steel sheets. The tensile strength of each of the specimens was measured by a tensile tester (Instron). A tensile strength change ΔTS, namely, a remainder of subtraction of the tensile strength of the specimen of the untreated steel sheet from that of the specimen of the processed steel sheet. Values of ΔTS not lower than 300 MPa were determined to be acceptable. Values of ΔTS are shown in Table 2.

Test pieces of each specimen were welded together by an arc welding process and a weld zone was examined for blowholes to evaluate weldability. Test pieces of 70 mm×400 mm were cut out from the 1 mm thick specimen. One of the test piece was lapped over the other with a overlapping width of 5 mm and the joint of the test pieces was fillet-welded by a $CO_2$ arc welding process using a 0.8 mm diameter welding wire YGW12 commercially available from Kobe Seiko Sho. A bead of 300 mm in length was examined for blowholes by an x-ray transmission test. It was decided that the weldability of the specimen was rated "bad weldability" when even a single blowhole was found. In Table 2, a circle indicates good weldability and a cross indicates bad weldability.

TABLE 1

| | Composition (% by mass) | | | | | | | | |
|---|---|---|---|---|---|---|---|---|---|
| | C | Si | Mn | P | S | Al | N | Ti | Ti* |
| A | 0.0020 | 0.10 | 0.30 | 0.005 | 0.001 | 0.030 | 0.0040 | 0.052 | 0.043 |
| B | 0.0020 | 0.10 | 0.30 | 0.005 | 0.001 | 0.030 | 0.0040 | 0.035 | 0.026 |
| C | 0.0020 | 0.10 | 0.30 | 0.005 | 0.001 | 0.030 | 0.0040 | 0.085 | 0.076 |
| D | 0.05 | 0.10 | 1.50 | 0.005 | 0.001 | 0.030 | 0.0040 | 0.260 | 0.059 |
| E | 0.0020 | 0.10 | 0.30 | 0.005 | 0.001 | 0.030 | 0.0040 | 0.011 | 0.002 |
| F | 0.0020 | 0.10 | 0.30 | 0.005 | 0.001 | 0.030 | 0.0040 | 0.119 | 0.110 |

TABLE 2

| No. | Type of steel | Temperature for nitriding process (° C.) | Temperature for denitrating process (° C.) | Temperature for Ti nitride precipitating process (° C.) | N content (%) | Coarse precipitated grains | Ti nitride grain density (grains/μm$^2$) | Δ TS (MPa) | Weldability |
|---|---|---|---|---|---|---|---|---|---|
| 1 | A | 550 | 550 | 650 | 0.015 | Not any | 269 | 320 | ○ |
| 2 | A | 550 | 600 | 650 | 0.014 | Not any | 270 | 310 | ○ |
| 3 | A | 600 | 550 | 650 | 0.015 | Not any | 266 | 320 | ○ |
| 4 | A | 600 | 600 | 650 | 0.014 | Not any | 270 | 310 | ○ |
| 5 | B | 550 | 550 | 650 | 0.012 | Not any | 265 | 300 | ○ |
| 6 | C | 550 | 550 | 650 | 0.018 | Not any | 277 | 350 | ○ |
| 7 | D | 550 | 550 | 650 | 0.017 | Not any | 280 | 340 | ○ |
| 8 | A | 550 | — | — | 0.03 | Many | 120 | 320 | X |
| 9 | A | 600 | — | — | 0.04 | Many | 140 | 330 | X |
| 10 | A | 650 | — | — | 0.08 | Many | 170 | 340 | X |
| 11 | A | 650 | 550 | 650 | 0.08 | Many | 235 | 370 | X |
| 12 | A | 650 | 600 | 650 | 0.07 | Many | 188 | 360 | X |
| 13 | A | 650 | 650 | 650 | 0.08 | Many | 192 | 370 | X |
| 14 | A | 650 | 550 | 550 | 0.08 | Many | 210 | 360 | X |
| 15 | A | 650 | 550 | 600 | 0.08 | Many | 206 | 370 | X |
| 16 | A | 550 | 650 | 650 | 0.023 | Many | 175 | 300 | X |
| 17 | A | 600 | 650 | 650 | 0.023 | Many | 130 | 340 | X |
| 18 | A | 550 | 550 | 550 | 0.015 | Not any | 178 | 220 | ○ |
| 19 | A | 550 | 550 | 600 | 0.015 | Not any | 201 | 250 | ○ |
| 20 | A | 600 | 550 | 550 | 0.015 | Not any | 167 | 220 | ○ |
| 21 | A | 600 | 550 | 600 | 0.015 | Not any | 196 | 250 | ○ |
| 22 | E | 550 | 550 | 650 | 0.005 | Some | 20 | 20 | ○ |
| 23 | F | 550 | 550 | 650 | 0.023 | Some | 230 | 400 | X |

The following conclusion can be drawn through the examination of the data shown in Tables 1 and 2. Specimens Nos. 1 to 7 meeting the requirements of the present invention and nitrided after rolling are high-strength steel sheets that could be manufactured at a low rolling force. In the high-strength steel sheets thus manufactured, the number of Ti nitride grains having a maximum size of 20 nm or below in 1 μm$^2$ is 250 or above. Therefore, those high-strength steel sheets have high strength and satisfactory weldability because the N content thereof is 0.020% or below.

The specimens Nos. 8 to 23 do not meet the requirements of the present invention. The specimens Nos. 8 to 10 processed only by a nitriding process have an excessively high N content and bad weldability. The specimens Nos. 11 to 15 processed by a nitriding process at a high temperature contain a small amount of coherently precipitated Ti nitride grains and coarse precipitated grains, particularly coarse nitrides, and have bad weldability. The steels of the specimens Nos. 8 and 9 have a high N content and many clusters produced therein. Although those steels are strengthened, the weldability thereof is deteriorated because the N content is high. The specimens Nos. 10 to 15 processed by a nitriding process at a high temperature contain a large amount of N and coarse nitride grains. Although the coarse nitride grains contribute to strengthening, the coarse nitride grains make formation of fine Ti nitride grains difficult because the coarse nitride grains are difficult to decompose.

The specimens Nos. 16 and 17 processed by a denitrating process at a high temperature contain coarse precipitated grains (particularly, nitrides) that strengthen the steel and have bad weldability. The specimens Nos. 18 to 21 processed by a Ti nitride precipitating process at a low temperature do not contain Ti nitride and have insufficient strength. The specimen No. 22 has a low effective Ti* content, no Ti nitride is produced therein and is not strengthened. The specimen No. 23 has a high effective Ti* content, contains Ti nitride grains having a maximum size above 20 nm, has high strength and an increased N content that deteriorates weldability.

EXAMPLE 2

A hat-channel-shaped formed article was obtained by processing an untreated steel sheet of 1 mm in thickness, 40 mm in width and 210 mm in length of a type A steel having a composition shown in Table 1 by press working. The hat-channel-shaped article had a height of 60 mm and a punched bottom width of 48 mm.

Strain in the longitudinal wall of the formed article was changed during forming by changing blank holding force (BHF) and die shoulder radius (Rd). The BHF was varied in the range of 2 to 5 tf, and the Rd was 3 mm or 5 mm. Values of BHF and Rd used for forming are shown in Table 3.

Stain in the longitudinal wall of the formed article was calculated by using a measured thickness before press working and a measured thickness after press working and the following expression. The thickness of a part is measured at a height of 30 mm from the punched bottom and at 20 mm from an end of the formed article in a widthwise direction. Measured values are shown in Table 3. The untreated steel sheet not processed by press working had a strain of 0%.

(Strain)=[{(Thickness before press working)−(Thickness after press working)}/(Thickness before press working)]×100

The surface of the formed article was degreased, and the formed article was subjected to a nitriding process, a denitrating process and a Ti nitride precipitating process in that order in an annealing furnace.

Temperatures used by the nitriding process, the denitrating process and the Ti nitride precipitating process are shown in Table 3. Other conditions for the nitriding process, the denitrating process and the Ti nitride precipitating process are the same as those for Example 1.

A specimen No. 35 shown in Table 3 was processed only by the nitriding process and was not processed by the denitrating process and the Ti nitride precipitating process.

Then, the respective N contents of formed articles, the metallographic structure (existence of coarse precipitated grains, and the number of Ti nitride grains having a maximum size of 20 nm or below in 1 $\mu m^2$) and weldability of the formed articles were evaluated by the same procedure as that used for evaluating the specimens of Example 1.

The Vickers hardness ($Hv_1$) of each formed article immediately after forming and the Vickers hardness ($Hv_2$) of each formed article after the nitriding process, the denitrating process and the Ti nitride precipitating process were measured instead of measuring the tensile strength of the formed article. Strength was evaluated on the basis of hardness difference $\Delta Hv$ calculated by using: $\Delta Hv=Hv_2-Hv_1$. Hardness of a part at a distance of t/2 from the surface of a part of the sheet where t means the thickness of the sheet.

TABLE 3

| No. | Type of steel | BHF (tf) | Rd (mm) | Strain (%) | Temperature for denitrating process (° C.) | Temperature for denitrating process (° C.) | Temperature for Ti nitride precipitating process (° C.) | N content (%) | Coarse precipitated grains | Ti nitride grain density (grains/$\mu m^2$) | Δ Hv | Weldability |
|---|---|---|---|---|---|---|---|---|---|---|---|---|
| 31 | A | — | — | 0 | 550 | 550 | 650 | 0.014 | Not any | 266 | 100 | ○ |
| 32 | A | 2 | 5 | 5.2 | 550 | 550 | 650 | 0.015 | Not any | 274 | 98 | ○ |
| 33 | A | 5 | 5 | 10.2 | 550 | 550 | 650 | 0.015 | Not any | 269 | 101 | ○ |
| 34 | A | 5 | 3 | 15.2 | 550 | 550 | 650 | 0.015 | Not any | 273 | 105 | ○ |
| 35 | A | 5 | 3 | 14.9 | 650 | — | — | 0.083 | Many | 162 | 114 | X |
| 36 | A | 5 | 3 | 14.7 | 550 | 650 | 650 | 0.026 | Many | 183 | 96 | X |
| 37 | A | 5 | 3 | 15.4 | 550 | 550 | 550 | 0.015 | Not any | 167 | 79 | ○ |

The following conclusion can be drawn through the examination of the data shown in Table 3. Specimens Nos. 31 to 34 are high-strength members respectively having large hardness differences, and excellent in weldability. It is known from the comparison of the specimen No. 31 and the specimens Nos. 32 to 34 that the Ti nitride precipitating process is effective whether the steel sheet is processed by press working (specimen No. 31) or whether the steel sheet is not processed by press working (specimens Nos. 32 to 34). It is known from the comparative examination of the specimens Nos. 32 to 34 that the change of strain caused by the forming process affects scarcely the change of hardness caused by the nitriding process, the N content after the Ti nitride precipitating process and the density of Ti nitride after the Ti nitride precipitating process.

As regards the specimens No. 35 to 37, conditions for the nitriding process, the denitrating process or the Ti nitride precipitating process do not meet the requirements of the present invention and hence Ti nitride grains are not properly precipitated in the processed formed articles. The specimen No. 35 processed only by the nitriding process has a high N content, contains many coarse precipitated gains and have bad weldability. The specimen No. 36 processed by the denitrating process at a high temperature has two phases ($\alpha+\gamma$), a high N content, and hence has bad weldability. Since the amount of coherently precipitated Ti nitride is small, the hardness is not sufficiently high. The specimen No. 37 processed by the Ti nitride precipitating process at a low temperature has a small amount of Ti nitride precipitate and is deficient in hardness.

The invention claimed is:

1. A high-strength steel comprising:

0.05% (percent by mass unless otherwise specified in describing chemical composition) or below C (excluding 0%), 0.05 to 1% Si, 1.5% or below Mn (excluding 0%), 0.05% or below P (excluding 0%), 0.05% or below S (excluding 0%), 0.05% or below Al (excluding 0%), 0.02 to 0.3% Ti, and 0.020% or below N (excluding 0%);

having metallographic structure of a single phase of ferrite; and comprising Ti nitride grains having a maximum size of 20 nm or below and coherently precipitated in a density of 250 grains/$\mu m^2$ or above.

2. The high-strength steel material according to claim 1, wherein the ratio of the number of Ti nitride grains having a maximum size of 6 nm or below to that of Ti nitride grains having a maximum size of 20 nm or below is 80% or above.

3. The high-strength steel material according to claim 1 having an effective Ti* content calculated by using Expression (1) in the range of 0.02 to 0.08%, $$Ti^*=[Ti]-48\times([C]/12+[S]/32) \quad (1)$$

where a numeral in [ ] indicates an element content (%) of the steel material.

4. A high-strength steel of claim 1, consisting essentially of:

0.05% (percent by mass unless otherwise specified in describing chemical composition) or below C (excluding 0%), 0.05 to 1% Si, 1.5% or below Mn (excluding 0%), 0.05% or below P (excluding 0%), 0.05% or below S (excluding 0%), 0.05% or below Al (excluding 0%), 0.02 to 0.3% Ti, and 0.020% or below N (excluding 0%);

having metallographic structure of a single phase of ferrite; and containing Ti nitride grains having a maximum size of 20 nm or below and coherently precipitated in a density of 250 grains/$\mu m^2$ or above.

* * * * *